US006528438B2

(12) United States Patent
Payet

(10) Patent No.: US 6,528,438 B2
(45) **Date of Patent: *Mar. 4, 2003**

(54) DURABLE PRESS/WRINKLE-FREE PROCESS

(75) Inventor: George L. Payet, Cincinnati, OH (US)

(73) Assignee: The Procter & Gamble Company, Cincinnati, OH (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

This patent is subject to a terminal disclaimer.

(21) Appl. No.: 09/270,061

(22) Filed: Mar. 16, 1999

(65) Prior Publication Data

US 2001/0001331 A1 May 24, 2001

Related U.S. Application Data

(63) Continuation of application No. 09/075,334, filed on May 11, 1998, now Pat. No. 5,885,303.
(60) Provisional application No. 60/046,298, filed on May 13, 1997.

(51) Int. Cl.[7] ..... D06M 13/12
(52) U.S. Cl. ..... 442/104; 442/105; 442/106; 442/107; 442/414; 442/327; 442/369; 442/333; 442/152; 442/153; 8/116.4; 8/115.6; 8/115.7; 8/116.1
(58) Field of Search ..... 442/104, 105, 442/106, 107, 414, 327, 369, 333, 152, 153; 8/116.4, 115.6, 115.7, 116.1

(56) References Cited

U.S. PATENT DOCUMENTS

| | | | | | |
|---|---|---|---|---|---|
| 2,243,765 | A | | 5/1941 | Morton | 536/56 |
| 3,663,974 | A | * | 5/1972 | Watanabe et al. | 8/116.4 |
| 3,841,832 | A | | 10/1974 | Swidler et al. | 8/116.4 |
| 3,960,482 | A | | 6/1976 | Payet | 8/116.4 |
| 4,108,598 | A | | 8/1978 | Payet | 8/115.7 |
| 4,184,004 | A | | 1/1980 | Payet | 442/102 |
| 4,312,993 | A | | 1/1982 | Martin | 556/419 |
| 4,331,797 | A | | 5/1982 | Martin | 528/26 |
| 4,396,390 | A | | 8/1983 | Hendrix et al. | 8/116.4 |
| 4,520,176 | A | * | 5/1985 | Martin et al. | 524/598 |
| 4,530,874 | A | * | 7/1985 | Hendrix et al. | 442/102 |
| 4,619,864 | A | | 10/1986 | Hendrix et al. | 442/157 |
| 5,458,544 | A | | 10/1995 | Fujiwara et al. | 474/205 |
| 5,879,410 | A | | 3/1999 | Yanai et al. | 8/181 |
| 5,885,303 | A | * | 3/1999 | Payet | 6/116.4 |
| 6,375,685 | B2 | * | 4/2002 | Payet | 8/116.4 |
| 2001/0001794 | A1 | * | 5/2001 | Payet | 525/418 |
| 2001/0049247 | A1 | * | 12/2001 | Mellea et al. | 442/414 |
| 2001/0051486 | A1 | * | 12/2001 | Mellea et al. | 442/414 |
| 2001/0052193 | A1 | * | 12/2001 | Payet et al. | 34/444 |
| 2002/0031970 | A1 | * | 3/2002 | Arredondo et al. | 442/414 |
| 2002/0049019 | A1 | * | 4/2002 | Maxfield et al. | 442/130 |
| 2002/0138916 | A1 | * | 10/2002 | Payet | 8/115.51 |
| 2002/0138917 | A1 | * | 10/2002 | Payet | 8/115.51 |
| 2002/0144354 | A1 | * | 10/2002 | Payet | 8/142 |

OTHER PUBLICATIONS

Odian, Principles of Polymerization, John Wiley & Sons, New York (1981), p. 35.*
C.M. Carr, Chemistry of the Textiles Industry (1995), pp. 271–272.*
Book of Papers; AATCC 1982 National Technical Conference, J.V. Isharani, "Ultratex—New Breed of Textile Finish", pp. 144–153 (Oct. 1982).

* cited by examiner

*Primary Examiner*—Alan Diamond
(74) *Attorney, Agent, or Firm*—Dinsmore & Shohl LLP

(57) ABSTRACT

Cellulosic fiber-containing fabrics are made wrinkle resistant by a durable press wrinkle-free process which comprises treating a cellulosic fiber-containing fabric with formaldehyde, a catalyst capable of catalyzing the crosslinking reaction between the formaldehyde and cellulose and a silicone elastomer, heat-curing the treated cellulose fiber-containing fabric, preferably having a moisture content of more than 20% by weight, under conditions at which formaldehyde reacts with cellulose in the presence of the catalyst without a substantial loss of formaldehyde before the reaction of the formaldehyde with cellulose to improve the wrinkle resistance of the fabric in the presence of a silicone elastomeric softener to provide higher wrinkle resistance, and better tear strength after washing, with less treatment.

38 Claims, No Drawings

DURABLE PRESS/WRINKLE-FREE PROCESS

CROSS REFERENCE TO RELATED APPLICATION

This application is a continuation of application Ser. No. 09/075,334, filed May 11, 1998, now U.S. Pat. No. 5,885,303, which claims benefit under 35 U.S.C. §119(e) of provisional application Serial No. 60/046,298 filed May 13, 1997.

BACKGROUND OF THE INVENTION

1. Field of Invention

This invention relates to a durable press/wrinkle-free process for cellulosic fiber-containing fabrics and more particularly to a process which permits high treatment level amounts of formaldehyde and catalysts to impart wrinkle resistance to the cellulosic fiber-containing fabrics while reducing the loss in both tensile and tear strength normally associated with such treatment processes.

2. Description of Related Art

There are a number of known process for treating cellulosic fiber-containing fabrics, such as cotton-containing fabrics, to make them wrinkle-free. These treatment processes include resin or polymer treatment of the fabric, but these are costly and unsatisfactory. Another process for treating cellulosic fiber-containing products relies on formaldehyde to provide durable crosslinking of the cellulose molecules and to thereby impart durable crease resistant and smooth drying characteristics to these products. However, problems have been encountered with the known processes. A simple, reproducible, completely satisfactory low-cost formaldehyde durable press process has not yet been achieved.

It has long been known to treat cellulosic materials with formaldehyde, as is evidenced by U.S. Pat. No. 2,243,765. This patent describes a process for treating cellulose with an aqueous solution of formaldehyde containing a small proportion of an acid catalyst under such conditions of time and temperature that the reaction is allowed to approach its equilibrium. It is further stated that, in carrying out this process, the proportion of the solution of formaldehyde to the cellulose must be at least such that the cellulose is always in a fully swollen state. It is also stated that the time and temperature of the treatment with the solution of formaldehyde and acid catalyst will vary with one another, the time required increasing rapidly as the temperature diminishes. When it is desired, the product may be isolated by washing and drying; preferably at a temperature of about 212° F. The products obtained according to this process are said to show no increase in wet strength and possess a high water imbibition, an increased resistance to creasing and a slight increase in affinity to some direct dyes.

In recent years additional methods have been devised for treating cellulosic fiber-containing products in order to impart durable crease retention, wrinkle resistance and smooth drying characteristics to these products. As discussed, formaldehyde has been crosslinked with cellulose materials to produce these products. It is also known to treat cellulose materials with resins or precondensates of the urea-formaldehyde or substituted urea-formaldehyde type to produce a resin treated durable press product. As noted in U.S. Pat. No. 3,841,832, while formaldehyde has made a significant contribution to the cotton finishing art, the result has been far from perfect. For instance, in some cases the formaldehyde crosslinking treatment has tended to lack reproducibility, since control of the formaldehyde crosslinking reaction has been difficult. As noted in U.S. Pat. No. 4,396,390, lack of reproducibility is especially true on a commercial scale.

Moreover, unacceptable loss of fabric strength has also been observed in many of the proposed aqueous formaldehyde treatment processes. When high curing temperatures were used with an acid or potential acid catalyst, excess reaction and degradation of the cotton often happened which considerably impaired its strength. On the other hand, when attempts were made to achieve reproducibility at temperatures of 106° F. or less, much longer reaction or finishing times were usually required, rendering the process economically relatively unattractive. A solution to this is set forth in U.S. Pat. No. 4,108,598, the entire disclosure of which is herein incorporated by reference.

SUMMARY OF THE INVENTION

In accordance with the present invention it is possible to obtain good durable press properties in a cellulosic fiber-containing fabric with good strength retention with a process that produces consistent results. This invention relates to a durable press/wrinkle-free process for cellulosic fiber-containing fabrics and more particularly to a process which utilizes formaldehyde and catalysts with silicone elastomers to impart wrinkle resistance to the cellulosic fiber-containing fabrics while reducing loss in both tensile and tear strength. This process is particularly effective on 100% cotton fabric.

DESCRIPTION OF PREFERRED EMBODIMENTS

Such cellulosic fiber-containing fabrics include cloth made of cotton or cotton blends. There is a constant consumer demand for better treatment, that is, a more wrinkle-free product and for higher amounts of cotton in the blended fabric, or preferably, a 100% cotton fabric. There is a great demand for a wrinkle-free fabric made entirely of cotton and having good tensile and tear strength. This has been achieved and 100% cotton fabrics are treated today, but only in heavier weight pants or bottom weight fabrics. Unfortunately, the more wrinkle-free the cellulosic containing fabric is made by treatment in a formaldehyde system, the greater the loss in tear and tensile strength.

That is, as the amount of chemicals used in the treating process are increased to obtain an acceptable wrinkle resistance in the treated fabric, the loss in tear and tensile strength fall to unacceptable levels. Polyester fibers are most often blended into the cotton to form a polyester cotton blend fabric to compensate for the loss in strength of the treated cotton. Polyester in amounts of up to 65% are commonly used. Because of the presence of polyester fibers or other synthetic fibers in the blend, these blended fabrics are sufficiently strong but do not have the comfort or feel of fabrics containing a higher amount of cotton, or most desirably, 100% cotton. The process of the present invention overcomes the disadvantages of the prior art processes and permits the presence of higher percentages of cotton in the blend and even the treatment of lighter weight or shirting weight 100% cotton fabrics to a commercially acceptable wrinkle free standard while retaining adequate strength in the fabric to also make it commercially acceptable. Commercial acceptability of the treated fabric is the ultimate goal of the process.

The durable press process of the present invention for treating cotton containing fabrics and 100% cotton fabric, comprises treating a cellulosic fiber-containing fabric with aqueous formaldehyde and a catalyst capable of catalyzing the crosslinking reaction between formaldehyde and cellulose in the presence of a silicone elastomer, heat curing the treated cellulosic fiber-containing fabric, preferably having a moisture content of more than 20% by weight, under conditions at which formaldehyde reacts with the cellulose in the presence of a catalyst and without the substantial loss of formaldehyde before the reaction of formaldehyde with cellulose to improve the wrinkle resistance of the fabric while reducing the loss in both tensile and tear strength. It is preferable that the cellulose containing fabric is in the fully swollen state.

Any silicone eslastomer may be used in the present invention. Silicone elastomers are known materials. Silicone elastomers have a backbone made of silicon and oxygen with organic substituents attached to silicon atoms comprising n repeating units of the general formula:

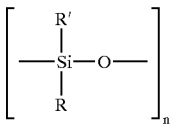

The groups R and $R^1$ may be the same or different and includes for example, lower alkyl, such as methyl, ethyl, propyl, phenyl or any of these groups substituted by hydroxy groups, fluoride atoms or amino groups; in other words, reactive groups to cellulose.

The silicones used to make the silicone elastomers in the present invention are made by conventional processes which may include the condensation of hydroxy organosilicon compounds formed by hydrolysis of organosilicon halides. The required halide can be prepared by a direct reaction between a silicon halide and a Grignard reagent. Alternate methods may be based on the reaction of a silane with unsatutrated compounds such as ethylene or acetylene. After separation of the reaction products by distillation, organosilicon halides may be polymerized by carefully controlled hydrolysis to provide the silicone polymers useful in the present invention.

For example, elastomers may be made by polymerization of the purified tertramer using alkaline catalysts at 212–302 degrees F., the molecular weight being controled by using a monofunctional silane. Curing characteristics and properties may be varied over a wide range by replacing some methyl groups by —H, —OH, fluoroalkly, alkoxy or vinyl groups and by compounding with fillers as would be appreciated by one of ordinary skill in the art.

Silicone elastomers used in the present invention are high weight materials, generally composed of dimethyl silicone units (monomers) linked together in a linear chain. These materials usually contain a peroxide type catalyst which causes a linking between adjacent methyl groups in the form of methylene bridges. The presence of crosslinking greatly improves the durability of the silicone elastomer on cellulose by producing larger molecules.

It is also possible to produce a reactive silicone elastomer, which is one where reactive groups capable of reacting with the substrate have been added to the linear dimethyl silicone polymer. These silicones are capable of reacting both with cellulose substrates as well as with most protein fibers, and are characterized by much greater durability of the silicone polymer on the substrate, even approaching the life of the substrate.

Therefore silicone elastomers which give off reaction gases or chemicals indicating chemical reaction with the substrate are much preferred over non reactive silicone elastomer, but this is not to say that non reactive silicone elastomers cannot be used in the process. Different elastomers, by different manufacturers have all shown increases in tensile as well as tear strength, as shown in Tables I and II included herein. Elastomeric silicone polymers have been found to increase strength whereas simple emulsified silicone oils (or lubricants) do not give increases in tensile strength.

The aqueous system containing formaldehyde, an acid catalyst, silicone elastomer and a wetting agent may be padded on the fabric to be treated, preferably to insure a moisture content of more than 20% by weight on the fabric, and then the fabric cured. The padding technique is conventional to the art and generally comprises running the fabric through the aqueous solution which is then passed through squeezing rollers to provide a wet pick-up of about 66%. As is conventional in the art, the concentration of the reactants in the aqueous solution are adjusted to provide the desired amount of reactants on the weight of the fabric (OWF).

It is possible to use unexpected high temperatures which allow the crosslinking reaction to take place before the loss of formaldehyde is great enough to affect the process and provide inadequate treatment. In accordance with this aspect of the invention, the padded fabric may be immediately plunged into a heating chamber at from about 300 to about 325° F. This is an important commercial aspect of the invention as it enables continuous processing on a commercial scale at speeds of 100–200 yards per minute. It must be appreciated, that this process is designed for commercial applications which are demanding in that the process must be commercially viable.

This may also be accomplished by curing at a low temperature with an active catalyst. It is also possible to use any combination of techniques which prevent the substantial loss of formaldehyde during the curing. For example, a low temperature may be used in combination with an aqueous formaldehyde solution. It would also be possible to use a pressurized system wherein the pressure is greater than atmospheric, thereby preventing the substantial loss of formaldehyde before the formaldehyde crosslinks with the cellulosic fiber-containing fabric being treated.

In addition the process of the present invention uses less formaldehyde than other known processes. Shirting fabrics treated in accordance with the process of the present invention contain approximately 1000 ppm after treatment before steaming on a shirting fabric as compared to 3000 ppm+ by another crosslinking process on a similar shirting fabric. Tests have shown that continuously running steaming chambers to which the treated fabric is exposed should effectively remove residual formaldehyde to concentrations as low as 200 ppm. This is also an important aspect of the present invention in view of consumers concern about the presence of formaldehyde in their purchased garments. It is also possible to wash fabrics either continuously or in batch washers. Both approaches remove essentially all of the formaldehyde.

It is known to add to the fabric a polymeric resinous additive that is capable of forming soft film. For example, such additives may be a latex or fine aqueous dispersion of polyethylene, various alkyl acrylate polymers, acrylonitrile-butadiene copolymers, deacetylated ethylene-vinyl acetate copolymers, polyurethanes and the like. Such additives are well known to the art and are generally commercially available in concentrated aqueous latex form. Such a latex is diluted to provide about 1 to 3% polymer solids in the aqueous catalyst-containing padding bath before the fabric is treated therewith. One known softener which was virtually the softener of choice in the durable press process using resin treatment or formaldehyde crosslinking was high density polyethylene, Mykon HD. It has been unexpectedly discovered that the substitution of a silicone elastomer for high density polyethylene significantly reduces the loss in tear strength of the treated fabric after washing as well as providing better control of the process as may be seen from the examples. The importance of good control of the process is essential to a commercially viable process to provide a consistent product from run to run which is not adversely affected by variations in atmospheric pressure, humidity and the like.

As the cellulosic fiber-containing fabric which may be treated by the present process there can be employed various natural cellulosic fibers and mixtures thereof, such as cotton and jute, Other fibers which may be used in blends with one or more of the above-mentioned cellulosic fibers are, for example, polyamides (e.g., nylons), polyesters, acrylics (e.g., polyacrylonitrile), polyolefins, polyvinyl chloride, and polyvinylidene chloride. Such blends preferably include at least 35 to 40% by weight, and most preferably at least 50 to 60% by weight, of cotton or natural cellulose fibers.

The fabric may be a resinated material but preferably it is unresinated; it may be knit, woven, non-woven, or otherwise constructed. After processing, the formed wrinkle resistant fabric will maintain the desired configuration substantially for the life of the fabric. In addition, the fabric will have an excellent wash appearance even after repeated washings.

This invention is not dependent upon the limited amounts of moisture to control the crosslinking reaction since the crosslinking reaction is most efficient in the most highly swollen state of the cellulose fiber. Lesser amounts of moisture may be used but are less preferred.

However, the silicone elastomer must be present in a sufficient amount to reduce the loss of tensile and tear strength in the fabric normally associated with the treatment of the same fabric in a prior art treatment process which may include the use of softeners such as Mykon HD. The formulation and process of the present invention may be adjusted to meet specific commercial requirements for the treated fabric. For example, formaldehyde and the catalyst concentration may be increased to provide better treatment; then the concentration of the softener is also increased to combat the loss of tear strength caused by the increased amount of catalyst used in the process. This lends itself to computerized control of the systems for treating various fabrics and allows variation in the treatment of different fabrics, which is another advantage of the process of the present invention.

While silicone oils are known as silicone softeners and have found some use in fabric treatment, they suffer serious disadvantages in having a strong tendency to produce non-removable spots. However, the particular silicone elastomer used in the process of the present invention completely overcomes these problems.

Blended fabrics to be treated in accordance with the present invention are immersed in a solution to provide a pick up or on the weight of fabric (OWF) of about 3% formaldehyde, 1% of catalyst, 1% of the silicone elastomer. This requires a pickup of about 66% by weight of the aqueous formulation to achieve the above stated percentage of reactants on the fabric. However, when treating 100% cotton fabric chemical concentrations must be increased so that 5% formaldehyde OWF, about 2% catalyst and about 2% elastomer padded onto the fabric. This is contrary to the prior art attempts to treat 100% cotton where the concentration of reactants were decreased because of the loss of strength due to the treatment process. The curing temperature may be about 300° F. In fact, the padded fabric may be plunged into a oven or heating chamber at 300° F.

The formaldehyde concentration may be varied as would be appreciated by one of ordinary skill in the art. The process inlcudes the use of formaldehyde in the form of an aqueous solution having a concentration of 0.5% to 10%, by weight. The preferred formaldehyde concentration on the fabric is from 1.5% to 7% based on the weight of the fabric.

The catalyst used in the process includes fluorosilicic acid for mild reactions and is applicable to blend fabrics. On heavyweight, all-cotton fabrics, or shirting fabrics, a catalyst such as magnesium chloride spiked with citric acid can be used, which is a commercially available catalyst Freecat No. 9, as is a similar catalyst which contains aluminum/magnesium chloride. During the crosslinking reaction at the curing stage, moisture is given up from the fabric as the crosslinking occurs, resulting in a decrease in the moisture content of the fabric. In fabrics having a moisture content of 20% or less, this tends to lower the effectiveness of the crosslinking reaction requiring higher concentrations of formaldehyde. In a preferred aspect of the present invention, moisture is given up from a high level, that is, greater than 20%, preferably greater than 30%, e.g., from 60–100% or more, and the crosslinking is optimized. Moisture, which is so difficult to control, is not a problem in the present invention. Of course, water is not allowed to be present in so much of an excess as to cause the catalyst to migrate on the fabric.

All results reported in the following examples were obtained by the following standard methods:

1. Appearance of Fabrics after Repeated Home Launderings: AATCC Test Method 124-1992
2. Tensile Strength: ASTM:Test Method D-1682-64 (Test 1C)
3. Tear Strength: ASTM: Test Method D-1424-83 Falling Pendulum Method
4. Shrinkage: AATCC Test Method 150-1995
5. Wrinkle Recovery of Fabrics: Recovery Angle Method: AATCC Test Method 66-1990 which provides the DP value.

In determining the DP value for the fabrics, a visual comparative test is performed under controlled lighting conditions in which the amount of wrinkles in the treated fabric is compared with the amount of wrinkles present on pre-wrinkled plastic replicas. The plastic replicas have various degrees of wrinkles and range from a value of 1 DP for a very wrinkled fabric to 5.0 DP for a flat wrinkle free fabric. The higher the DP value, the better. For a commercially acceptable wrinkle free fabric, a DP value of 3.5 is desired but rarely achieved. As would be appreciated by one of ordinary skill in the art, the difference between a DP of 3.50 and 3.25 is significant. At DP 3.50 all wrinkles are rounded and disappearing. At DP 3.25 all wrinkles are still visible and show sharp creases. The goal for commercial acceptance is a DP of 3.50 with a filling tensile strength 25 pounds and a filling tear strength of 24 ounces. Of equal or even greater importance to these properties is that the process must be consistently reproducible on an industrial scale.

In all of the following examples a non-ionic wetting agent was used as is conventional to the art. The wetting agent was used in an amount of about 0.1% by weight. The wetting agent used in all of the examples was an alkyl aryl polyether alcohol such as Triton X-100. The wetting agent is used to cause complete wetting by the aqueous treating solution of the fibers in the fabric.

All of the samples were run on all-cotton fabrics which are the most difficult to treat because of the severe loss in tensile and tear strength, which causes the treated fabric to be commercially unacceptable. The normal industry standard for tear and tensile strength for an all cotton shirting fabric is characterized by having a filling tensile strength of 25 pounds and a filling tear strength of 24 ounces. The cotton fabric must meet and/or exceed this standard. The test conditions are set forth in the table.

The silicone elastomer was the commercially available softener Sedgefield Elastomer Softener ELS, which is added as an opaque white liquid which contains from 24–26% silicone, has a pH of from 5.0–7.0 and is readily dilutable with water. When used in the present invention, this product produced DP values at catalyst concentrations of 0.8%, whereas with the Mykon HD, a catalyst concentration of 2.0% was required to give a DP value of 3.50 after 1 washing and 3.25 after 5 washings.

The tensile strength with a catalyst concentration of 0.8% and tear strength are significantly and unexpectedly higher than the 2.0% catalyst required with Mykon HD to give equal DP results. Catalyst concentration of 1.0% ELS is recommended to ensure a margin of safety, such that any variation in treatment will be well within accepted specifications.

The following examples are being presented not as limitations but to illustrate and provide a better understanding of the invention. In order to confirm the fact that formaldehyde was being lost from the conventional processes, experiments were conducted in which the fabric was heated very quickly by very hot air as in the conventional processes as well as in accordance with the present invention.

EXAMPLE 1

As indicated, it is possible to cure with a high enough temperature that the crosslinking reaction is achieved before sufficient formaldehyde is lost preventing good treatment. In this experiment, 100% cotton oxford shirting was padded with formaldehyde (37%) at a concentration of 5.0% OWF, 0.8% OWF of Freecat #9 Accelerator manufactured by Freedom Textile Chemicals Co. and 1.5% OWF of a silicone elastomeric softener, Sedgesoft ELS manufactured by Sedgefield Specialties, to a pickup of approximately 60–70%. The sample was then dried and cured while under tension in an air circulating oven set at 300° F. for 10 minutes.

EXAMPLE 2

Another sample of the same fabric as used in Example 1 was padded with a similar solution differing only in that the catalyst Accelerator #9 was 1.0% OWF. Otherwise the sample was treated precisely the same.

EXAMPLE 3

Another sample of the same fabric as used in Example 1 was padded with a similar solution differing only in that the catalyst Accelerator #9 was 2.0% OWF. Otherwise the sample was treated precisely the same.

EXAMPLE 4

Another sample of the same fabric as used in Example 1 was padded with a similar solution differing only in that the catalyst Accelerator #9 was 0.4% OWF, and Mykon HD was substituted for the Sedgesoft ELS elastomeric Softener. Otherwise the sample was treated precisely the same.

EXAMPLE 5

Another sample of the same fabric as used in Example 1 was padded with a similar solution differing only in that the catalyst Accelerator #9 was 0.8% OWF, and Mykon HD was substituted for the Sedgesoft ELS elastomeric Softener. Otherwise the sample was treated precisely the same.

EXAMPLE 6

Another sample of the same fabric as used in Example 1 was padded with a similar solution differing only in that the catalyst Accelerator #9 was 1.0% OWF, and Mykon HD was substituted for the Sedgesoft ELS elastomeric Softener. Otherwise the sample was treated precisely the same.

EXAMPLE 7

Another sample of the same fabric as used in Example 1 was padded with a similar solution differing only in that the catalyst Accelerator #9 was 1.5% OWF, and Mykon HD was substituted for the Sedgesoft ELS elastomeric Softener. Otherwise the sample was treated precisely the same.

EXAMPLE 8

Another sample of the same fabric as used in Example 1 was padded with a similar solution differing only in that the catalyst Accelerator #9 was 2.0% OWF, and Mykon HD was substituted for the Sedgesoft ELS elastomeric Softener. Otherwise the sample was treated precisely the same.

EXAMPLE 9

A sample of the same fabric was washed in a home washer and tumble tried, but not treated with any crosslinking process.

EXAMPLE 10

Another sample of the same fabric served as an untreated, unwashed control.

TABLE NO. I

Sedgefield Silicone Elastomeric Softener ELS vs. MykonHD, High Density Polyethylene
Sample Treatment Date: May 1996
Fabric: New Cherokee 100% Cotton Oxford Shirting

| Example No. | Fabric Type | $CH_2O$ % OWF | Cat # 9 % OWF | Softener | Amount % OWF | Cure Temp. ° F. | Cure Time Min. |
|---|---|---|---|---|---|---|---|
| 1 | Oxford | 5.0 | 0.8 | ELS | 1.5 | 300 | 10 |
| 2 | Oxford | 5.0 | 1.0 | ELS | 1.5 | 300 | 10 |
| 3 | Oxford | 5.0 | 2.0 | ELS | 1.5 | 300 | 10 |
| 4 | Oxford | 5.0 | 0.4 | Mykon HD | 1.5 | 300 | 10 |
| 5 | Oxford | 5.0 | 0.8 | Mykon HD | 1.5 | 300 | 10 |
| 6 | Oxford | 5.0 | 1.0 | Mykon HD | 1.5 | 300 | 10 |
| 7 | Oxford | 5.0 | 1.5 | Mykon HD | 1.5 | 300 | 10 |
| 8 | Oxford | 5.0 | 2.0 | Mykon HD | 1.5 | 300 | 10 |
| 9 | Control Unwashed | — | — | — | — | — | — |
| 10 | Control Washed | — | — | — | — | — | — |

| Example No. | Tensile[1] W × F | Tear[1] W × F | Shrink 1 Wash W × F % | DP 1 Wash | Shrink 5 Washes W × F % | DP 5 Wash |
|---|---|---|---|---|---|---|
| 1 | 45.3 × 46.0 | 59.4 × 45.2 | 1.08 × 0.58 | 3.50 | 1.50 × 0.83 | 3.50 |
| 2 | 43.7 × 41.3 | 48.5 × 42.9 | 0.75 × 0.58 | 3.50 | 1.25 × 0.67 | 3.50 |
| 3 | 30.0 × 29.0 | 28.9 × 25.5 | 0.75 × 0.67 | 3.50 | 0.92 × 0.75 | 3.50 |
| 4 | 61.8 × 69.8 | 103.8 × 79.5 | 2.00 × 1.42 | 2.0 | 2.50 × 1.08 | 2.00 |
| 5 | 53.0 × 56.2 | 72.9 × 53.4 | 1.67 × 1.08 | 2.75 | 1.83 × 0.92 | 2.50 |
| 6 | 47.2 × 47.2 | 60.3 × 42.4 | 1.17 × 0.83 | 3.25 | 1.17 × 0.67 | 2.50 |
| 7 | 39.3 × 37.5 | 36.6 × 26.6 | 0.83 × 0.67 | 3.25 | 0.75 × 0.33 | 3.00 |
| 8 | 34.7 × 35.0 | 27.8 × 25.5 | 0.75 × 0.67 | 3.50 | 0.75 × 0.42 | 3.25 |
| 9 | 74.3 × 99.0 | 120.1 × 133.2 | 2.00 × 1.58 | <1.0 | 4.42 × 1.83 | <1.0 |
| 10 | 71.7 × 100.8 | 35.7 × 63.9 | — | — | — | — |

[1]Evaluated after treatment but before washing.

It is clear in Table No. I that samples treated with the elastomeric softener produced higher degrees of durable press than any of the samples treated with Mykon HD. Tensile Strengths are similar as is shrinkage for each degree of treatment.

In another experiment, the results shown in Table No. II, samples of 100% cotton oxford shirting were padded with two concentrations of formaldehyde 3.0 and 5.0% OWF, each concentration also treated with three concentrations of Accelerator #9 Catalyst, 0.8, 1.0, and 2.0% . In one half of the samples, Sedgesoft ELS was applied and in the other half Mykon HD was used as the softener. Both softeners were applied at 1.5% OWF. Each of the samples were padded with the respective solutions shown in Table No. II, then cured at 300° F. for 10 minutes under tension. All samples were treated in precisely the same way, intervals were timed.

It is clearly seen in Table II (Example 11 to Example 22 and the control) that after 5 washes, the Sedgesoft ELS samples have almost twice the tear strength of the Mykon HD samples without exception. In addition, again seen, the DP values are higher indicating better smoothness.

TABLE NO. II

Treatment: Comparison of Softeners, Sedgesoft ELS vs. Mykon HD
Sedgesoft ELS: Silicone Polymer Emulsion
Mykon HD: Polyethylene Emulsion
Specification Strength: Tensile, Filling: 25 lbs.; Tear, Filling: 24 oz.

| Example No. | Fabric New Cherokee Oxford Shirting | $CH_2O$ % OWF | Cat # 9 % OWF | Softener Type | Softener Amt. % OWF | Cure/Time F./Min. | Tensile[1] Lbs. W × F | Tear[1] Oz. W × F |
|---|---|---|---|---|---|---|---|---|
| 11 | 100% Cotton | 3.0 | 0.8 | ELS | 1.5 | 300/10 | 51.8 × 53.3 | 66.2 × 49.0 |
| 12 | 100% Cotton | 3.0 | 1.0 | ELS | 1.5 | 300/10 | 43.7 × 39.7 | 44.0 × 36.6 |
| 13 | 100% Cotton | 3.0 | 2.0 | ELS | 1.5 | 300/10 | 31.8 × 29.3 | 27.5 × 21.0 |
| 14 | 100% Cotton | 3.0 | 0.8 | HD | 1.5 | 300/10 | 54.8 × 55.7 | 75.2 × 50.8 |
| 15 | 100% Cotton | 3.0 | 1.0 | HD | 1.5 | 300/10 | 49.7 × 48.7 | 60.9 × 41.1 |
| 16 | 100% Cotton | 3.0 | 2.0 | HD | 1.5 | 300/10 | 38.2 × 34.2 | 29.4 × 23.3 |
| 17 | 100% Cotton | 5.0 | 0.8 | ELS | 1.5 | 300/10 | 46.7 × 44.0 | 56.4 × 35.4 |
| 18 | 100% Cotton | 5.0 | 1.0 | ELS | 1.5 | 300/10 | 43.2 × 38.2 | 40.6 × 30.5 |
| 19 | 100% Cotton | 5.0 | 2.0 | ELS | 1.5 | 300/10 | 30.8 × 27.3 | 26.6 × 27.5 |
| 20 | 100% Cotton | 5.0 | 0.8 | HD | 1.5 | 300/10 | 51.5 × 49.0 | 63.2 × 43.6 |
| 21 | 100% Cotton | 5.0 | 1.0 | HD | 1.5 | 300/10 | 44.0 × 46.0 | 40.0 × 31.8 |
| 22 | 100% Cotton | 5.0 | 2.0 | HD | 1.5 | 300/10 | 33.2 × 32.5 | 26.6 × 21.0 |
| Washed Control (5 Washes) | | | | | | | | |

TABLE NO. II-continued

| | | | | | | | |
|---|---|---|---|---|---|---|---|
| | Treatment: | Comparison of Softeners, Sedgesoft ELS vs. Mykon HD | | | | | |
| | Sedgesoft ELS: | Silicone Polymer Emulsion | | | | | |
| | Mykon HD: | Polyethylene Emulsion | | | | | |
| | Specification Strength: | Tensile, Filling: 25 lbs.; Tear, Filling: 24 oz. | | | | | |
| | 100% Cotton | — | — | — | — | — | 74.1 × 106.7 | 77.4 × 103.8 |
| Example No. | Shrink 1 Wash W × F % | DP 1 Wash | Shrink 5 Wash W × F % | DP 5 Washes | Tensile[2] 5 Washes W × F | Tear[2] 5 Washes W × F |
| 11 | 2.50 × 1.42 | 2.75 | 3.50 × 1.75 | 2.75 | 52.2 × 60.0 | 54.2 × 68.8 |
| 12 | 1.83 × 1.42 | 3.00 | 2.500 × 1.67 | 2.90 | 47.0 × 53.2 | 42.9 × 40.6 |
| 13 | 1.25 × 1.17 | 3.25 | 1.75 × 1.42 | 3.00 | 34.2 × 34.5 | 26.6 × 24.1 |
| 14 | 2.00 × 1.58 | 2.75 | 2.92 × 2.00 | 2.00 | 56.8 × 65.8 | 29.4 × 32.3 |
| 15 | 1.75 × 1.17 | 3.00 | 2.50 × 1.75 | 2.50 | 54.0 × 60.0 | 27.8 × 29.8 |
| 16 | 1.17 × 1.255 | 3.25 | 1.67 × 1.33 | 3.00 | 35.5 × 39.8 | 19.6 × 19.9 |
| 17 | 1.92 × 1.25 | 2.75 | 2.42 × 1.33 | 2.90 | 47.0 × 59.5 | 50.3 × 65.5 |
| 18 | 1.58 × 1.08 | 3.00 | 1.91 × 1.00 | 3.00 | 38.0 × 51.8 | 43.3 × 58.0 |
| 19 | 1.08 × 0.92 | 3.25 | 0.75 × 0.75 | 3.25 | 30.0 × 37.3 | 28.7 × 33.2 |
| 20 | 2.00 × 1.67 | 2.50 | 2.58 × 1.67 | 2.75 | 49.7 × 67.5 | 28.7 × 42.9 |
| 21 | 1.67 × 1.58 | 2.50 | 2.00 × 1.33 | 3.00 | 49.3 × 52.0 | 29.8 × 37.7 |
| 22 | 1.08 × 0.92 | 3.00 | 1.08 × 1.00 | 3.15 | 26.3 × 41.0 | 17.6 × 19.9 |
| Washed Control (5 Washes) | 2.92 × 1.67 | <1.0 | 3.30 × 1.00 | <1.0 | 70.1 × 109.7 | 37.7 × 59.4 |

[1]Evaluated after treatment but before washing.
[2]Evaluated after 5 washings.

What is claimed is:

1. A treated fabric comprising cellulosic fibers, the treated fabric being produced by a process utilizing formaldehyde and catalyst with silicone elastomer to impart wrinkle resistance, the process including the steps of:

(a) treating a fabric comprising cellulosic fibers with a liquid treatment composition comprising water, formaldehyde and catalyst; and (b) heat curing the fabric treated with the liquid composition;

wherein the liquid treatment composition is free of resin and the moisture content of the fabric at the start of the heat curing step is greater than 30%, on weight of fabric, and the silicone elastomer is included in the treated fabric in an amount effective to reduce loss of tear or tensile strength of the treated fabric.

2. A treated fabric according to claim 1, wherein the liquid treatment composition comprises from 0.5% to 10%, by weight, formaldehyde.

3. A treated fabric according to claim 1, wherein the moisture content of the fabric at the start of the heat curing step is from 60% to 100%, on weight of fabric.

4. A treated fabric according to claim 1, wherein the fabric is treated with a reactive silicone elastomer comprising from 24% to 26% by weight silicone.

5. A treated fabric according to claim 1, wherein the catalyst comprises magnesium chloride and citric acid.

6. A treated fabric according to claim 5, wherein the liquid treatment composition further comprises a nonionic wetting agent.

7. A treated fabric according to claim 1, wherein after 5 washes the treated fabric has a filling tear strength of from 24.1 to 66.8 ounces and a filling tensile strength of from 37.3 to 60.0 pounds.

8. A treated fabric according to claim 7, wherein after 5 washes the treated fabric has a durable press value of from 2.75 to 5.

9. A treated fabric according to claim 8, wherein after 5 washes the treated fabric exhibits a shrinkage in the warp direction of from 0.75 to 3.5%, and a shrinkage in the fill direction of from 0.75% to 1.75%.

10. A treated fabric according to claim 1, wherein the liquid treatment composition comprises from about 0.24% to about 0.52% on weight of fabric of silicone.

11. A treated fabric comprising cellulosic fibers, the treated fabric being produced by the method comprising the steps of:

(a) contacting a fabric comprising cellulosic fibers with a liquid treatment composition comprising formaldehyde, magnesium chloride, silicone elastomer and water; and (b) heat curing the fabric treated with the liquid treatment composition;

wherein the treatment is free of resin, the moisture content of the fabric at the start of the heat curing step is greater tan 30%, on weight of fabric, and the silicone elastomer is included in the treated fabric in an amount effective to reduce loss of tear or tensile strength of the treated fabric.

12. A treated fabric according to claim 11, wherein after the step of heat curing, the fabric comprises about 1000 ppm formaldehyde.

13. A treated fabric according to claim 11, wherein after 5 washes the treated fabric has a filling tear strength of from 24.1 to 66.8 ounces and a filling tensile strength of from 37.3 to 60.0 pounds.

14. A treated fabric according to claim 13, wherein after 5 washes the treated fabric has a durable press value of from 2.75 to 3.5.

15. A treated fabric according to claim 11, wherein step (a) comprises padding the fabric with 5%, on weight of fabric, of a composition comprising 37%, by weight, formaldehyde.

16. A treated fabric according to claim 15, wherein step (a) further comprises padding the fabric with 1.5%, on weight of fabric, of a reactive silicone elastomer comprising from 24% to 26%, by weight, silicone.

17. A treated fabric according to claim 16, wherein the fabric comprises at least 60%, by weight, cellulosic fibers.

18. A treated fabric according to claim 11, wherein the liquid treatment composition comprises from about 0.24% to about 0.52% on weight of fabric of silicone.

19. A treated fabric prepared by a process comprising:

(a) treating a fabric comprising cellulosic fibers with an aqueous liquid treatment composition comprising formaldehyde, a catalyst, and silicone elastomer to form an elastomer-treated fabric (b) heat curing the elastomer-treated fabric;

wherein the silicone elastomer is included in the treated fabric in an amount effective to reduce loss of tear or tensile strength of the treated fabric as compared to a fabric having the same fiber content which, prior to heat curing, is treated with a composition comprising formaldehyde, catalyst and emulsified silicone oil; and wherein the treated fabric is unresinated.

20. A treated fabric according to claim 19, wherein the moisture content of the fabric at the start of the heat curing step is greater than 30%, on weight of fabric.

21. A treated fabric according to claim 20, wherein the moisture content of the fabric at the start of the heat curing step is from 60% to 100%, on weight of fabric.

22. A treated fabric according to claim 19, wherein the process further comprises the step of steaming the fabric after heat curing, wherein after steaming the fabric comprises residual formaldehyde at a level as low as 200 ppm.

23. A treated fabric according to claim 19, wherein the liquid treatment composition comprises from about 0.24% to about 0.52% on weight of fabric of silicone.

24. A treated fabric comprising a silicone elastomer and cross-linked cellulosic fibers, wherein the cross-linked cellulosic fibers are provided by treating cellulosic fibers with a liquid treatment composition free of resin and comprising formaldehyde, catalyst, reactive silicone elastomer and water, and wherein the silicone elastomer is included in the treated fabric in an amount effective to reduce loss of tear or tensile strength of the treated fabric.

25. A treated fabric according to claim 24, wherein after 5 washes the treated fabric has a durable press value of from 2.75 to 3.5.

26. A treated fabric according to claim 25, wherein after 5 washes the treated fabric has a filling tensile strength of from 37.3 to 60.0 pounds.

27. A treated fabric according to claim 25, wherein the treated fabric comprises at least 35%, by weight, cellulosic fiber and further comprises a non-cellulosic fiber selected from the group consisting of polyamides, polyesters, acrylics, polyolefins, polyvinyl chloride, polyvinylidene chloride, and mixtures thereof.

28. A treated fabric according to claim 24, wherein the liquid treatment composition comprises from about 0.24% to about 0.52% on weight of fabric of silicone.

29. A treated fabric comprising a silicone elastomer and formaldehyde cross-linked cellulosic fibers, wherein the formaldehyde cross-linked cellulosic fibers are prepared by (a) padding a fabric comprising cellulosic fibers with a sufficient amount of liquid treatment composition comprising water, formaldehyde and catalyst such that the cellulosic fibers are highly swollen; and (b) heat curing the padded fabric, wherein the liquid treatment composition is free of resin, and wherein the silicone elastomer is included in the treated fabric in an amount effective to reduce loss of tear or tensile strength of the treated fabric.

30. A treated fabric according to claim 29, wherein the silicone elastomer has a backbone made of silicon and oxygen atoms with organic substituents attached to the silicon atoms comprising repeating units having a formula:

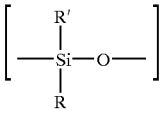

in which R and R' are each independently selected from the group consisting of methyl, ethyl, propyl, phenyl, and these groups substituted by hydroxy, fluoride or amino groups.

31. A treated fabric according to claims 29, wherein the fabric is padded with sufficient liquid treatment composition such that the moisture content of the fabric at the start of the heat curing step is greater than 30%, by weight.

32. A treated fabric according to claim 31, wherein the moisture content of the fabric at the start of the heat curing step is from 60% to 100%, by weight.

33. A treated fabric according to claim 29, wherein the fabric is padded with the liquid treatment composition to a pickup of from 60% to 70%, by weight.

34. A treated fabric according to claim 33, wherein the liquid treatment composition comprises from 0.5% to 10%, by weight, formaldehyde.

35. A treated fabric according to claim 29, wherein after heat curing the fabric comprises about 1000 ppm formaldehyde.

36. A treated fabric according to claim 29, wherein the liquid treatment composition consists essentially of water, formaldehyde, catalyst, reactive silicone elastomer and non-ionic wetting agent.

37. A treated fabric according to claim 29, wherein the treated fabric exhibits a reduced loss in tear strength as compared to high density polyethylene-provided fabric comprising formaldehyde cross-linked cellulosic fibers.

38. A treated fabric according to claim 29, wherein the liquid treatment composition comprises from about 0.24% to about 0.52% on weight of fabric of silicone.

* * * * *